United States Patent [19]

Yamazaki et al.

[11] Patent Number: 4,677,044

[45] Date of Patent: Jun. 30, 1987

[54] MULTI-LAYERED ELECTROPHOTOGRAPHIC PHOTOSENSITIVE MEMBER HAVING AMORPHOUS SILICON

[75] Inventors: Toshinori Yamazaki, Hachioji; Eiichi Sakai, Niiza; Tatsuo Nakanishi; Hiroyuki Nomori, both of Hachioji, all of Japan

[73] Assignee: Konishiroku Photo Industry Co., Ltd., Tokyo, Japan

[21] Appl. No.: 730,474

[22] Filed: May 3, 1985

[30] Foreign Application Priority Data

May 9, 1984 [JP] Japan ..... 59-92062
May 9, 1984 [JP] Japan ..... 59-92063
May 9, 1984 [JP] Japan ..... 59-92065
May 9, 1984 [JP] Japan ..... 59-92066

[51] Int. Cl.[4] ..... G03G 5/082

[52] U.S. Cl. ..... 430/58; 403/66; 403/84

[58] Field of Search ..... 430/54, 57, 66, 126, 430/84, 95

[56] References Cited

U.S. PATENT DOCUMENTS 4,477,549 10/1984 Fujimaki et al. ..... 430/54
4,492,810 1/1985 Ovshinsky et al. ..... 430/85
4,495,262 1/1985 Matsuzaki et al. ..... 430/95
4,510,224 4/1985 Yamazaki et al. ..... 430/57

*Primary Examiner*—John L. Goodrow
*Attorney, Agent, or Firm*—Jordan B. Bierman

[57] ABSTRACT

A photosensitive member wherein a charge transporting layer, a charge generating layer, and a surface modifying layer are laminated on a retainer. The charge transporting layer is prepared from one selected from a group of a-SiC:H, a-SiC:F, a-SiC:H:F, a-SiN:H, a-SiN:F, and a-SiN:H:F, the charge generating layer is prepared from one selected from a group of a-Si:H, a-Si:F and a-Si:H:F; and the surface modifying layer is prepared from one selected from a group of a-SiC:H, a-SiC:F, a-SiC:H:F, a-SiN:H, a-SiN:F and a-SiN:H:F. The surface modifying layer contains 1~50 atomic % of oxygen, 100 atomic % in total of Si, C (or N) and 0 atoms.

8 Claims, 5 Drawing Figures

MULTI-LAYERED ELECTROPHOTOGRAPHIC PHOTOSENSITIVE MEMBER HAVING AMORPHOUS SILICON

BACKGROUND OF THE INVENTION

1. Field of the Invention

This invention relates to a photosensitive member and more particularly to, for instance, an electrophotographic photosensitive member.

2. Description of the Prior Art

Heretofore, there have been known electrophotographic photosensitive members such as one prepared from Se or Se doped with As, Te, Sb and another prepared from a resin binder with ZnO and CdS dispersed therein. However, the problem with these electrophotographic photosensitive members is that they form a source of environmental pollution and lack both thermal stability and mechanical strength.

There has recently been proposed an electrophotographic photosensitive member using amorphous silicon (a-Si) as a host crystal. Amorphous silicon has a dangling bond, so to speak, wherein the Si—Si bond has been served and, because of this defect, there are a number of localized levels within an energy gap. For this reason, hopping conduction generated in the thermally-excited carrier causes dark resistance to remain small, whereas the photo-excited carrier is trapped at the localized level and reduces photoconductivity. Consequently, hydrogen atoms (H) are used to compensate for the defect by coupling H to Si and cover the dangling bond.

The specific resistance of the hydrogenated amorphous silicon (hereinafter called the "a-Si:H") in dark regions is $10^8 \sim 10^9 \Omega$-cm, which is roughly 1/10,000 lower than that of amorphous Se. Accordingly, the disadvantage of the photosensitive member comprising a single layer of a-Si:H is that the dark damping rate of the surface potential is large with the initial charging potential being low. The photosensitive layer of the member above has excellent characteristics, because its specific resistance will be reduced to a greater extent if light in visual and infrared regions is applied to the photosensitive member.

FIG. 1 shows an electrophotographic copying machine incorporating the a-Si:H as the base metal of a photosensitive member of a-Si series. The copying machine above comprises a document glass plate 3 for mounting an original 2 and a platen cover 4 for covering the original 2 in the upper portion of a cabinet 1; a light source 5 and a first reflection mirror 6 constituting a first mirror unit 7 as an optical scanner linearly horizontally movable under the glass plate 3; and a second mirror unit 20 for making constant the optical path length between the original scanning point and the photosensitive member, the second mirror unit 20 being moved at a velocity proportional to that of the first mirror unit. The light reflected from the glass plate 3 is made incident on a photosensitive drum 9 as an image retainer in the form of a slit through a lens 21 and a reflection mirror 8. The copying machine further comprises a corona charger 10, a developer 11, a transfer portion 12, a separator 13 and a cleaner 14 arranged around the drum 9, a toner image on the drum 9 being transferred onto copying paper 18 fed from a paper feeder box 15 through paper feeding roller 16, 17 and fixed by a fixing portion 19 before being discharged to a tray 35. In the fixing portion 19, the copying paper carrying a developed image therewith is passed between a heating roller 23 containing a heater 22 and a pressure roller 24 to effect the fixing operation.

However, whether or not the a-Si:H as the surface layer of the photosensitive member is chemically stable has not thoroughly been examined in terms of the influences derived from its long-term exposure to air or moisture and the type chemical of generated by corona discharge. For instance, what has been left untreated for more than one month is seen to be affected by moisture and the receptive potential is greatly reduced. "Phil. Mag. Vol. 35 (1978)", for example, refers to a method for manufacturing, and the existence of, amorphous hydrocarbonized silicon, which has made it clear that silicon is characterized by not only high heat resistance and surface hardness but also by shadow resistivity higher ($10^{12} \sim 10^{13} \Omega$-cm) than that of a-Si:H and a wide changeable energy gap depending on the quantity of carbon ranging from 1.6 to 2.8 eV. However, a drawback is that long wavelength sensitivity is poor because the band gap increases with the percentage of carbon contained.

Japanese Patent Application Laid-Open Gazzette 55-127,083 discloses such as electrophotographic photosensitive member constructed of a combination of a-SiC:H and a-Si:H, according to which the a-Si:H layer is used as a charge generating (photoconductive)layer and the a-SiC:H as a charge transporting layer provided under the charge generating layer to form a function separating type double layer construction, so that photosensitivity in a wide wavelength range and improved charge potential can be obtained from the upper a-Si:H layer and the lower a-SiC:H layer forming a hetero junction with the former, respectively. However, the dark attenuation of the a-Si:H layer is not sufficiently prevented and the charge potential is still insufficient to the extent that it cannot be put to practical use. Moreover, the presence of the a-Si:H layer on the surface has resulted in poor chemical stability, mechanical strength, heat resistance and the like of the product above.

According to Japanese Patent Application Laid-Open Gazette 57-17,952, the first a-SiC:H layer is formed as a surface modifying layer on a charge generating layer composed of a-Si:H and the second a-SiC:H layer is formed as a charge transporting layer on the under surface thereof (on the support electrode side). As for the above-described photosensitive member of the prior art, although the prevention of dark attenuation and the chemical stability of the surface are expected because of the surface modifying layer, the following problems are seen to have been posed:

That is, the specific resistance (dark resistivity) $\rho D$ of the a-SiC:H as one forming the surface modifying layer above is limited to and cannot exceed $10^{13} \Omega$-cm; consequently, the retention of the charge potential is insufficient. Moreover, if $SiO_2$ is used for the surface improving layer, although $\rho D$ will be increased, the active elements (ions, molecules and atoms in the discharge atmosphere) generated in the neighborhood of the charged electrode will readily be attracted to the surface and this will cause image flow to be easily produced as a creeping discharge occurs. Although it is true that the active elements such as $SiO_2$ are hardly attracted to the a-SiC:H, the capability of the charge potential retention (retention capability particularly at high temperature and moisture) since $\rho D$ is insufficient as described above.

SUMMARY OF THE INVENTION

An object of the present invention is to provide a photosensitive member whose surface is chemically stable, mechanically strong and highly heat-resistant, offering excellent photosensitivity and capability of charge potential retention, and producing almost no creeping discharge.

The photosensitive member according to the present invention comprises a charge transporting layer prepared from at least one selected from a group of a-SiC:H, a-SiC:F, a-SiC:H:F, a-SiN:H, a-SiN:F, and a-SiN:H: F; a charge generating layer prepared from at least one selected from a group of a-Si:H, a-Si:F and a-Si:H:F; and a surface modifying layer prepared from at least one selected from a group of a-SiC:H, a-SiC:F, a-SiC:H:F, a-SiN:H, a-SiN:F and a-SiN:H:F, said charge transporting, charge generating and surface modifying layers being laminated on a retainer, said surface modifying layer containing 1~50 atomic % of oxygen, 100 atomic % in total of Si, C (or N) and O atoms.

Since the surface modifying layer of a-SiC or a-SiN series (for instance, prepared from amorphous hydrocarbonized silicon (a-SiC:H) is provided according to the present invention, shortcomings with regard to the surface characteristics of the photosensitive material of a-Si series can be remedied. That is, the surface modifying layer functions to improve the surface potential characteristics of the photosensitive member of a-Si series, retain potential characteristics for a long period of time, maintain environmental resistance (suppression of the influence of types of chemical generated by humidity, atmosphere or corona discharge), improved resistance to wear because of greater surface hardness, heat resistance while the protosensitive member is used and thermal transfer efficiency (particularly, adhesive transfer efficiency).

Moreover, because the surface modifying layer contains 1~50 atomic % (hereinafter simply called the "%") of oxygen, the specific resistance of the surface modifying layer has substantially been improved ($>>10^{13}\Omega$-cm), as has also the capability of charge potential retention at high temperature or humidity. Conversely if the oxygen atoms contained are less than 1%, the above-described effect will not be obtainable, whereas if they exceed 50%, the image will be caused to flow by the adsorption of active elements. Accordingly, it is essential to set the percentage of oxygen contained in the surface modifying layer at 1~50% and preferably at 5~30%.

According to the present invention, 50 atomic ppm~5 atomic % (more preferably 50~500 atomic ppm) of oxygen is contained against the total number of Si+O+C (or N) atoms in the blocking layer to allow it to demonstrate the charge blocking capability and minimize the dependence ($d\rho D/dT$) of $\Delta D$ on temperature by effectively raising $\rho D$. In so doing, the charge potential retention characteristics are improved, so that the upper limit of temperature (also the upper limit of humidity) at which the photosensitive member is usable can be raised. If the quantity of oxygen thus contained is less than 50 atomic ppm, the effect of the oxygen contained will not be exhibited and, if it exceeds 5 atomic %, the mobility of the carrier, i.e., ($\mu\tau$) will be greatly reduced. Accordingly, it is essential to set the percentage of oxygen contained at 50 atomic ppm 5 atomic % and particularly desirable to set it at 50~500 atomic ppm.

According to the present invention, 50 atomic ppm~5 atomic % of oxygen is contained in the charge transporting layer against the total number of Si+C (or N) atoms being 100% to decrease the dependence ($d\rho D/dT$) of $\rho D$ on temperature by effectively raising the $\rho D$ without lowering the charge transporting capability ($\mu\tau$)c. In so doing, the charge potential retention characteristics can be improved, whereas the upper limit of temperature (also the upper limit of humidity) at which the photosensitive material is usable can be raised. If the quantity of oxygen contained therein is less than 50 atomic ppm, the effect of the oxygen contained will not be exhibited and, if it exceeds 5 atomic %, the excess oxygen will greatly reduce the mobility of the carrier, i.e., ($\mu\tau$)e. Accordingly, it is essential to set the quantity of oxygen contained at 50 atomic ppm~5 atomic % and preferably at 50~500 atomic ppm. Moreover, when this photoreceptor is used for positive charging since the charge transporting layer contains (or is lightly doped with) a relatively small quantity of elements defined by the group IIIa in the periodic table of elements, it contributes to making smooth the injection of the carrier from the charge generating layer to the charge transporting one.

Moreover, when there is provided a charge blocking layer containing (or heavily doped with) a large quantity of elements defined by the group IIIa in the periodic table of elements, it will effectively check the injection of electrons from the substrate side of the retainer while the photosensitive member is positively charged, offering excellent charge potential retention characteristics when the positively charged photosensitive member is used.

These and other objects of the invention will become more apparent in the detailed description and examples which follow, reference being had to the accompanying drawings forming a part thereof.

BRIEF DESCRIPTION OF THE DRAWINGS

FIG. 2 through 5 illustrates an embodiment of the present invention wherein;

FIG. 2 is a schematic cross section of an electrophotographic photosensitive member of a-Si series.

FIG. 3 is a schematic cross section of other electrophotographic photosensitive member of a-Si series.

FIG. 4 is a graph illustrating a comparison of the specific resistances of a-SiC.

FIG. 5 is a schematic cross section of the glow discharger.

DESCRIPTION OF THE PREFERRED EMBODIMENTS

An embodiment of the present invention will subsequently be described in detail.

Figure 1:
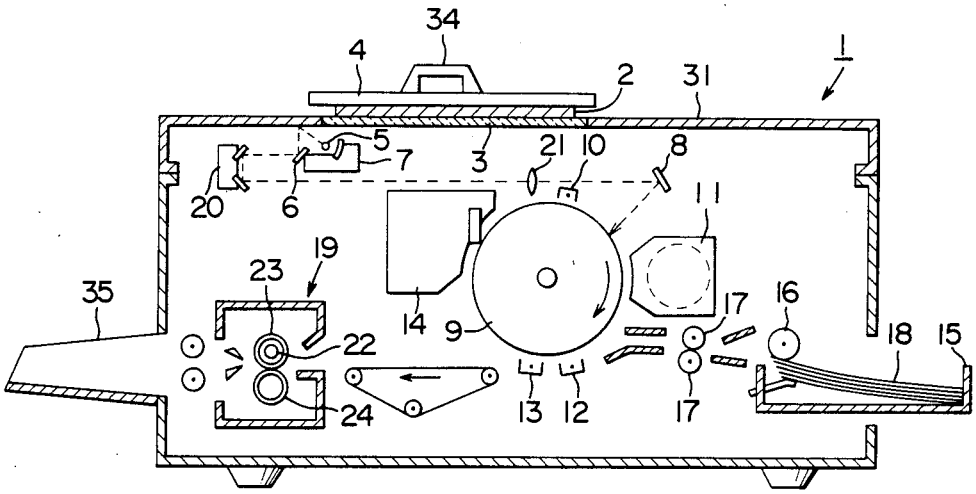
FIG. 1 PRIOR ART
FIG. 1 is a schematic cross section of a conventional electrophotographic copying machine.
Figure 2:
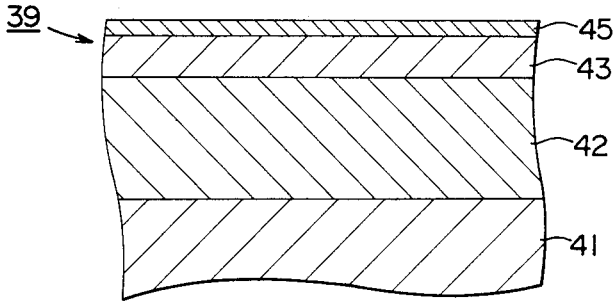

FIG. 2 shows an electrophotographic photosensitive member 39 of a-Si series for negative charging according to the embodiment of the present invention. The photosensitive member 39 comprises oxygen containing a-SiC:H layer (charge transporting layer) 42, an a-Si:H charge generating layer (photoconductive layer) 43 and an oxygen containing a-SiC:H layer (surface modifying layer) 45 successively laminated on a drum-like conductive support substrate 41. The oxygen containing a-SiC:H layer 42 mainly functions to retain the potential, transport a charge and improved the adhesion thereof to the substrate 41. It is important that the layer should contain 10~30 atomic % of carbon atoms (a percentage of C to the total number of Si and C) and moreover it should be 10 μm~30 μm thick.

Although a surface modifying layer 45 and/or charge transporting layer is composed of a-SiC:H, it may be composed of a-SiC:F, a-SiC:H:F, a-SiN:H, a-SiN:F or a-SiN:H:F with similar effects.

Figure 4:
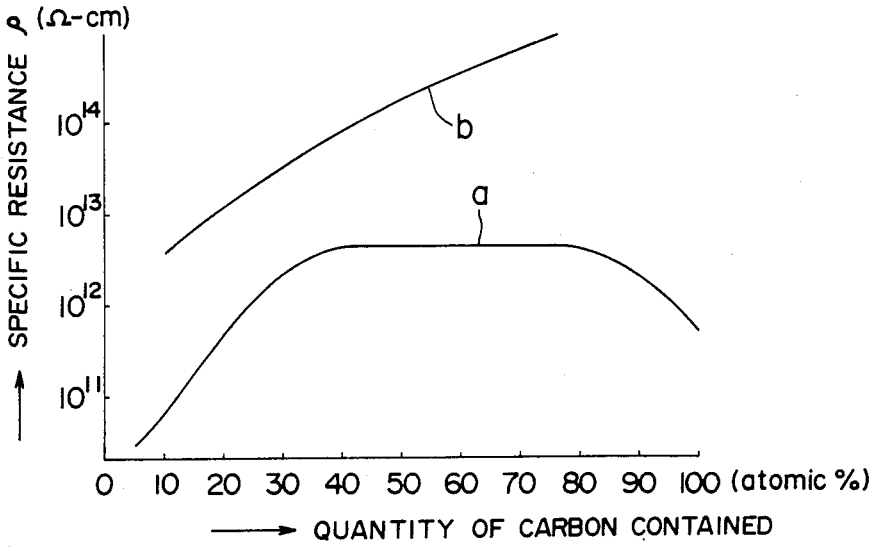

As the photosensitive member 39 according to the present invention allows the surface modifying layer 45 on the charge generating layer 43 to contain 1~50 atomic % oxygen in regard to the total number of Si, C and O atoms, the specific resistance is effectively raised, whereas the capability of charge potential retention can be greatly improved. In other words, as shown by a curve a of FIG. 4, the specific resistance is raised not to over near $10^{13}\Omega$-cm as the quantity of carbon contained is increased when the a-SiC:H only is used for the surface modifying layer. Conversely, in the case of O-containing a-SiC:H, i.e., oxygen is contained in the a-SiC:H according to the present invention (the quantity of oxygen contained being, for instance 5%), the specific resistance is largely increased as shown by a curve B. It was thus confirmed that the value became well over $10^{13}\Omega$-cm when the quantity of carbon contained was determined.

The O-containing surface modifying layer 45 is prerequisite to the modification of the surface of the photosensitive member of a-Si series for practical use. That is, such modification enables an electrophotographic photosensitive member to provide the basic operation such as the attenuation of the surface potential because of irradiation. Accordingly, repetitious charge and photoattenuation characteristics are extremely stabilized, which makes possible the regeneration of excellent potential characteristics even though the photosensitive member is left untreated for a long time (for instance, for more than one month). In the case of a photosensitive member with a-Si:H as its surface, conversely, it will readily be affected by humidity, the air, the ozone atmosphere and the like, whereby a change in the potential characteristics with the passage of time is greatly amplified. Moreover, because the surface hardness of a-SiC:H and a-SiN:H is excellent, it shows wear resistance in the development, transfer and cleaning processes and a process for adding heat as in the case of adhesive transfer is applicable thereto because of its excellent heat resistance.

In order to implement the aforementioned overall superior effect, it is important to select the atomic composition of the surface modifying layer 45. More specifically, when a-SiC:H is used, the quantity of carbon (nitrogen in the case of a-SiN:H) atoms contained should preferably be 10~70% with Si+C+O=100%. If the quantity of C(or N) contained is over 10%, specific resistance is a desired value, whereas the optical energy gap also is roughly over 20 eV. Consequently, irradiated beams are readily able to reach the a-Si:H layer (charge generating layer) 43 due to the so-called optically transparent window effect on visual and infrared light. However, if the quantity of C (or N) contained is less than 10%, the specific resistance will tend to be lower than a desired value in that the light is partially absorbed by the surface layer 45 and the sensitivity of the photosensitive member tends to decrease. If the quantity of C (or N) contained exceeds 70%, the carbon (or N) quantity in the layer will increase, causing the semiconductor characteristics to be degraded and, because the accumulation rate is apt to be reduced when the a-SiC:H or a-SiN:H film is formed through the glow discharge method, it is preferred to set the quantity of C (or N) contained at less than 70%.

In addition, importance is attached to the selection of the thickness of the surface layer 45 within a range of 400 Å≦t≦5000 Å (particularly 400 Å≦t<2000 Å). In other words, if the film thickness exceeds 5000 Å, the residual potential will become excessively high and the photosensitivity will also be reduced and thus the superior characteristics related to a photosensitive member of a-Si series will readily be degraded. Moreover, if the film thickness is set at less than 400 Å, dark attenuation will increase and photosensitivity will decrease because the surface is loaded with no charge due to the tunnel effect.

The charge generating layer 43 should be 1~10 μm thick. If the charge generating layer 43 is less than 1 μm thick, photosensitivity will be insufficient, whereas if the thickness exceeds 10 μm, the residual potential will rise so as to be unusable in practice.

Each of the above-described layers should contain hydrogen. In particular, the hydrogen contained in the charge generating layer 43 is prerequisite to compensation thereof for the dangling bond and improvement in photoconductivity and charge retention, the quantity of hydrogen contained being preferably 1~40 (preferably 10~30) atomic %. The range of the quantity contained therein is applicable to the surface modifying layer 45 and the charge transporting layer 42.

The charge transporting layer 42 may be composed of amorphous hydronitrogenized silicon (a-SiN:H). In this case, the quantity of nitrogen contained should be 10~30%. Moreover, both carbon and nitrogen may be contained in the charge transporting layer.

Figure 3:
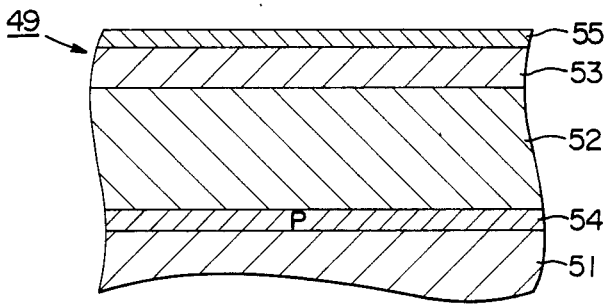

FIG. 3 shows another embodiment of the electrophotographic photosensitive member of a-Si series 49 for positive charging. The photosensitive member 49 comprises an oxygen containing p-type charge blocking layer 54 composed of a-SiC:H heavily doped with an element (for instance, boron) in the group IIIa of the periodic table of elements, a charge transporting layer 52 composed of a-SiC:H lightly doped with an element (for instance, boron) in the group IIIa of the periodic table of elements, a charge generating layer (photoconductive layer) 53 composed of a-Si:H and a surface modifying layer 55 composed of oxygen-containing amorphous hydrocarbonized silicon (O-containing a-SiC:H), the four layers above being laminated and mounted on a drum-like conductive support substrate 51 made of aluminum and the like.

The charge blocking layer 54 should be prepared from being doped with an element (for instance, boron) of the group IIIa of the periodic table of elements at a $B_2H_6/SiH_4$ flow ratio of 100~5000 vol ppm and reduced to the p-type (preferably p+ type) to fully prevent electrons from being injected from the substrate 51. Furthermore, the charge transporting layer 52 should be doped with impurities at a $B_2H_6/SiH_4$ flow ratio of 1~20 vol ppm. A suitable range of thickness should also be applied to each of the layers above and the charge generating layer 53 should be 1~10 μm. If the charge generating layer 53 is less than 1 μm thick, the photosensitivity will be insufficient and, if it is more than 10 μm thick, the residual potential will rise so as to be unsatisfactory for practical use. The charge transporting layer 52 should be 10~30 μm. If the blocking layer 54 is less than 400 Å, the blocking effect will be weak and, if it is more than 2 μm thick, the charge transporting capability will be deteriorated.

Each of the layers should contain hydrogen. In particular, the hydrogen contained in the photoconductive layer 53 is essential to compensation for the dangling bond and improvement in photoconductivity and charge retention, the quantity thereof should preferably be 1~40 (preferably 10~30) atomic %. The range of the quantity contained is also applicable to the surface modifying layer 55, the blocking layer 54 and the charge transporting layer 52. As an impurity for controlling the conductive type of the blocking layer 54, an element in the group IIIa such as Al, Ga, In, Tl, etc. other than boron may be used for p-type modification.

The quantity of carbon contained in the charge transporting layer 52 and the charge blocking layer 54 should be 10~30 atomic %. Both the layers 52, 54 may also be composed of amorphous hydronitrogenized silicon (a-SiN:H). In this case, the quantity of nitrogen contained should be 10~30 atomic %. The charge transporting layer may contain both carbon and nitrogen. Moreover, the surface modifying layer may be composed of a-SiN series.

Figure 5:
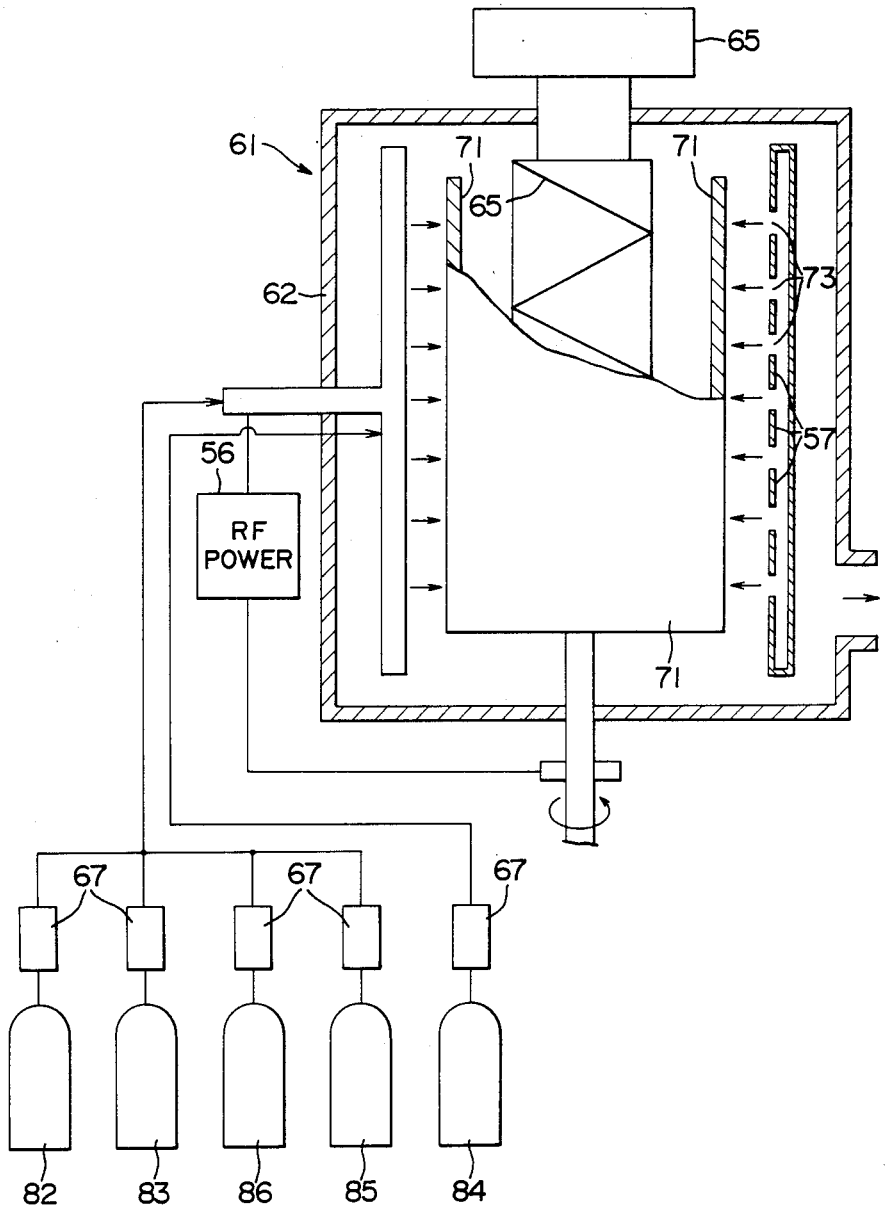

Subsequently referring to FIG. 5, the method of manufacturing the photosensitive member (for instance, in the form of a drum) and the device (glow discharge device) will be described.

In a vacuum tank 62 of a device 61, it is so arranged that a drum-like substrate 71 is vertically rotatably set and heated by a heater 65 at a predetermined temperature from the inside thereof. Cylindrical high-frequency electrodes 57 with gas outlets 73 are arranged opposite to and around the substrate 71 to cause a glow discharge therebetween using a high frequency power supply 56. There are shown a $SiH_4$ or gasified silicon supply source 82, a gasified oxygen compound supply source 83, a hydrocarbon gas such as $CH_4$ or nitrogen compound such as $NH_3$, $N_2$ gas supply source 86, a carrier gas such as Ar supply source 85, impure gas (for example $B_2H_6$) supply source 84 and flow meters 67. In the glow discharge device, the surface of a carrier, for instance, Al substrate 71 is cleaned first and the substrate is put in the vacuum tank 62 in such a manner that air is discharged to set the gas pressure in the vacuum tank 62 at $10^{-6}$ Torr and heated at 100°~350° C. (ideally 150°~300° C.). Subsequently, a high purity inert gas as the carrier gas, $SiH_4$ or a gasified silicon compound, $CH_4$ (or $NH_3$, $N_2$) and $O_2$ are properly introduced in the vacuum tank 62 and then a high-frequency voltage (for instance, 13.56 MHz) is applied using the high-frequency power supply 56 under a reaction pressure of, for instance, 0.01~10 Torr. Consequently, each reaction gas is decomposed between the electrode 57 and the substrate 71 by means of the glow discharge to accumulate oxygen containing a-SiC:H or a-SiN:H and O-containing a-SiC:H as the layers 42, 43, 45 or 54, 52, 53, 55 on continuously (as in the case of the example of FIG. 2 or FIG. 3).

In the above manufacturing method, since the carrier temperature is kept at 100°~350° C. during the process of preparing a film layer of a-Si series, excellent film quality (particularly electrical characteristics) of the photosensitive member becomes available.

To compensate for the dangling bond at the time of the formation of each layer of the photosensitive member of a-Si series, fluorine in place of or with H is introduced in the form of $SiF_4$ to provide a-Si:F, a-Si:H:F, a-SiN:F, a-SiN:H:F, a-SiC;F and a-SiC:H:F. The quantity of fluorine in this case should preferably be 0.5~10%.

Although the manufacturing method above employs the glow discharge decomposition method, it is also possible to use the sputtering method, ion-plating method, method of evaporating Si during the introduction of hydrogen activated or ionized by a hydrogen discharge tube (especially, the method disclosed by Japanese Patent Application Laid-Open Gazette 56-78,413 (Patent Application 54-152,455) according to the present inventors.

Referring to a concrete embodiment of the present invention will be described.

Based on the glow discharge decomposition method, an electrophotographic photosensitive member having the structure of FIG. 2 was prepared on a drum-like Al retainer. That is, the surface of the drum-like Al substrate 41 as a retainer having a flat surface was cleaned first and the substrate was put in a vacuum tank 62 of FIG. 5 and then the air was exhausted to set the gas pressure within the vacuum tank 62 at $10^{-6}$ Torr, whereas the substrate 71 was heated at 100°~350° C. (preferably 150°~300° C.). Subsequently, high purity Ar gas was introduced therein as a carrier gas and high-frequency power of 13.56 MHz in frequency was applied thereto at a back pressure of 0.5 Torr to effect a preliminary discharge for 10 minutes. Then a reaction gas consisting of $SiH_4$ and $CH_4$ was introduced and, by subjecting a mixed gas ($Ar+SiH_4+CH_4$) at a 1:1:1 flow ratio to the glow discharge decomposition, a-SiC:H layer 42 bearing the charge transporting function was prepared into a film having the predetermined thickness at an accumulation speed of 6 μm/hr. Subsequently, the supply of $CH_4$ was stopped and $SiH_4$ was decomposed through the discharge to prepare an a-Si:H layer 43 having the desired thickness. By subjecting a mixed gas ($Ar+SiH_4+CH_4+O_2$) at a 4:1:6:1 flow ratio to the glow discharge decomposition to prepare an O-containing a-SiC:H surface protecting layer 45. The electrophotographic photosensitive member and thus completed. Picture images were developed out of the photosensitive member using a copying machine (Modified U-Bix 3000 of Konishiroku Photo Industry) and the tests resulted in clear images with excellent resolution, gradation and image density without photographic fogs. Moreover, after 200,000 copies, the available picture images were still of good quality.

While the composition of each layer was changed in various ways, the results shown in the following table 1 were obtained.

Table 2 shows the results from the extrusion of picture images by an electrophotographic photosensitive member whose surface modifying layer 45 composed of a-SiN:H with the layer construction of FIG. 2.

Table 3 shows the results from the extrusion of picture images by an electrophotographic photosensitive member whose surface modifying layer 55 is composed of a-SiC:H with a layer construction of FIG. 3.

Table 4 shows the results from the extrusion of picture images by an electrophotographic photosensitive member whose surface modifying layer 55 is composed of a-SiN:H with the layer construction of FIG. 3.

TABLE 1

| No. | Charge transporting layer: Composition | C or N (%) | H (%)/F (%) | Film thickness (μm) | Charge generating layer: Composition | H (%)/F (%) | Film thickness (μm) |
|---|---|---|---|---|---|---|---|
| 1 | a-SiC:H | 15 | 20/0 | 15.5 | a-Si:H | 18/0 | 4.5 |
| 2 | " | " | " | " | " | " | " |
| 3 | " | " | " | " | " | " | " |
| 4 | " | " | " | " | " | " | " |
| 5 | " | " | " | " | " | " | " |
| 6 | " | " | " | " | " | " | " |
| 7 | " | " | " | " | " | " | " |
| 8 | " | " | " | " | " | " | " |
| 9 | a-SiN:H/F | 28 | 16/5 | " | a-Si:H/F | 17/6 | " |
| 10 | " | " | " | " | " | " | " |
| 11 | a-SiC:H/F | 11 | 18/6 | " | " | " | " |
| 12 | " | " | " | " | " | " | " |

| No. | Surface modifying layer: Composition | O (%) | C (%) | H (%)/F (%) | Film thickness (μm) | Working humidity of photosensitive member 50% Image quality after 200,000 copies white blanking and blur | Working humidity of photosensitive member 80% Image quality after 200,000 copies (while blanking and image flow) | Charging potential $V_0$ (V) |
|---|---|---|---|---|---|---|---|---|
| 1 | a-SiC:O:H | 1 | 40 | 20/0 | 0.15 | ○ | ○ | ⊖ 590 |
| 2 | " | 5 | " | " | " | ◎ | ◎ | ⊖ 620 |
| 3 | " | 10 | " | " | " | ◎ | ◎ | ⊖ 660 |
| 4 | " | 30 | 25 | " | " | ◎ | ◎ | ⊖ 670 |
| 5 | " | 50 | " | " | " | ○ | ○ | ⊖ 700 |
| 6 | " | 60 | " | " | " | Δ | Δ | ⊖ 710 |
| 7 | " | 0.8 | 40 | " | " | Δ | Δ | ⊖ 530 |
| 8 | " | 60 | 20 | " | " | Δ | X | ⊖ 720 |
| 9 | a-SiC:O:H/F | 5 | 30 | 17/6 | " | ◎ | ◎ | ⊖ 650 |
| 10 | " | 10 | 50 | " | " | ◎ | ◎ | ⊖ 660 |
| 11 | " | 5 | 30 | " | " | ◎ | ◎ | ⊖ 630 |
| 12 | " | 10 | 50 | " | " | ◎ | ◎ | ⊖ 650 |

In this Table, a-SiC:O:H represents O-containing a-SiC:H, while a-SiC:O:H/F represents an O-containing a-SiC:H:F.

TABLE 2

| No. | Charge blocking layer: Composition | C or N (%) | B-doping amount (ppm) $B_2H_6/SiH_4$ | H (%)/F (%) | Film thickness (μm) | Charge transporting layer: Composition | C or N (%) | B-doping amount (ppm) $B_2H_6/SiH_4$ | H (%)/F (%) | Film thickness (μm) |
|---|---|---|---|---|---|---|---|---|---|---|
| Embodiment 1 | a-SiC:H | 15 | 1500 | 20/0 | 1.0 | a-SiC:H | 15 | 5 | 20/0 | 14.5 |
| Embodiment 2 | " | " | " | " | " | " | " | " | " | " |
| Embodiment 3 | " | " | " | " | " | " | " | " | " | " |
| Embodiment 4 | " | " | " | " | " | " | " | " | " | " |
| Embodiment 5 | " | " | " | " | " | " | " | " | " | " |
| Comparison 1 | " | " | " | " | " | " | " | " | " | " |
| Comparison 2 | " | " | " | " | " | " | " | " | " | " |
| Embodiment 6 | a-SiN:H/F | 28 | 500 | 16/5 | " | a-SiN:H/F | 28 | 10 | 16/5 | " |
| Embodiment 7 | " | " | " | " | " | " | " | " | " | " |
| Embodiment 8 | a-SiC:H/F | 11 | 2500 | 18/6 | " | a-SiC:H/F | 11 | 2 | 18/6 | " |
| Embodiment 9 | " | " | " | " | " | " | " | " | " | " |

| No. | Charge generating layer: Composition | H (%)/F (%) | Film thickness (μm) | Surface modifying layer: Composition | O (%) | C (%) | H (%)/F (%) | Film thickness (μm) | Working humidity of photosensitive member 50% Image quality after 200,000 copies white blanking and blur | Working humidity of photosensitive member 80% Image quality after 200,000 copies white blanking and blur | Charging potential $V_0$ (V) |
|---|---|---|---|---|---|---|---|---|---|---|---|
| Embodiment 1 | a-Si:H | 18/0 | 4.5 | a-SiC:O:H | 1 | 40 | 20/0 | 0.15 | ○ | ○ | ⊕ 590 |
| Embodiment 2 | " | " | " | " | 5 | " | " | " | ◎ | ◎ | ⊕ 620 |
| Embodiment 3 | " | " | " | " | 10 | " | " | " | ◎ | ◎ | ⊕ 650 |
| Embodi- | " | " | " | " | 30 | 25 | " | " | ◎ | ◎ | ⊕ 670 |

TABLE 2-continued

| | | | | | | | | | | | |
|---|---|---|---|---|---|---|---|---|---|---|---|
| ment 4 | | | | | | | | | | | |
| Embodiment 5 | " | " | " | " | 50 | " | " | " | ○ | ○ | ⊕ 680 |
| Comparison 1 | " | " | " | " | 0.8 | " | " | " | Δ | Δ | ⊕ 550 |
| Comparison 2 | " | " | " | " | 60 | 20 | " | " | Δ | X | ⊕ 680 |
| Embodiment 6 | a-Si:H/F | 16/5 | " | a-SiC:O:H/F | 5 | 30 | 18/6 | " | ◎ | ◎ | ⊕ 650 |
| Embodiment 7 | " | " | " | " | 10 | 50 | " | " | ◎ | ◎ | ⊕ 670 |
| Embodiment 8 | " | " | " | " | 5 | 30 | " | " | ◎ | ◎ | ⊕ 660 |
| Embodiment 9 | " | " | " | " | 10 | 50 | " | " | ◎ | ◎ | ⊕ 680 |

In this Table, a-SiC:O:H represents O-containing a-SiC:H, while a-SiC:O:H/F represents O-containing a-SiC:H:F.

TABLE 3

| | Charge transporting layer | | | | Charge generating layer | | |
|---|---|---|---|---|---|---|---|
| No. | Composition | C or N (%) | H (%)/F (%) | Film thickness (μm) | Composition | H (%)/F (%) | Film thickness (μm) |
| 1 | a-SiC:H | 15 | 20/0 | 15.5 | a-Si:H | 18/0 | 4.5 |
| 2 | " | " | " | " | " | " | " |
| 3 | " | " | " | " | " | " | " |
| 4 | " | " | " | " | " | " | " |
| 5 | " | " | " | " | " | " | " |
| 6 | " | " | " | " | " | " | " |
| 7 | " | " | " | " | " | " | " |
| 8 | " | " | " | " | " | " | " |
| 9 | a-SiN:H/F | 28 | 16/5 | " | a-Si:H/F | 17/6 | " |
| 10 | " | " | " | " | " | " | " |
| 11 | a-SiC:H/F | 11 | 18/6 | " | " | " | " |
| 12 | " | " | " | " | " | " | " |

| | Surface modifying layer | | | | | Working humidity of photosensitive member 50% Image quality after | Working humidity of photosensitive member 80% Image quality after | |
|---|---|---|---|---|---|---|---|---|
| No. | Composition | O (%) | C (%) | H (%)/F (%) | Film thickness (μm) | 200,000 copies white blanking and blur | 200,000 copies white blanking and blur | Charging potential $V_0$ (V) |
| 1 | a-SiN:O:H | 1 | 40 | 20/0 | 0.15 | ○ | ○ | ⊖ 580 |
| 2 | " | 5 | " | " | " | ◎ | ◎ | ⊖ 600 |
| 3 | " | 10 | " | " | " | ◎ | ◎ | ⊖ 630 |
| 4 | " | 30 | 25 | " | " | ◎ | ◎ | ⊖ 650 |
| 5 | " | 50 | " | " | " | ○ | ○ | ⊖ 670 |
| 6 | " | 60 | 20 | " | " | Δ | Δ | ⊖ 670 |
| 7 | " | 0.8 | " | " | " | Δ | Δ | ⊖ 550 |
| 8 | " | 60 | 20 | " | " | Δ | X | ⊖ 680 |
| 9 | a-SiN:O:H/F | 5 | 30 | 17/6 | " | ◎ | ◎ | ⊖ 630 |
| 10 | " | 10 | 50 | " | " | ◎ | ◎ | ⊖ 650 |
| 11 | " | 5 | 30 | " | " | ◎ | ◎ | ⊖ 630 |
| 12 | " | 10 | 50 | " | " | ◎ | ◎ | ⊖ 660 |

TABLE 4

| | Charge blocking layer | | | | | Charge transporting layer | | | | |
|---|---|---|---|---|---|---|---|---|---|---|
| No. | Composition | C or N (%) | B-doping amount (ppm) $B_2H_6/SiH_4$ | H (%)/F (%) | Film thickness (μm) | Composition | C or N (%) | B-doping amount (ppm) $B_2H_6/SiH_4$ | H (%)/F (%) | Film thickness (μm) |
| Embodiment 1 | a-SiC:H | 15 | 1500 | 20/0 | 1.0 | a-SiC:H | 15 | 5 | 20/0 | 14.5 |
| Embodiment 2 | " | " | " | " | " | " | " | " | " | " |
| Embodiment 3 | " | " | " | " | " | " | " | " | " | " |
| Embodiment 4 | " | " | " | " | " | " | " | " | " | " |
| Embodiment 5 | " | " | " | " | " | " | " | " | " | " |
| Comparison 1 | " | " | " | " | " | " | " | " | " | " |
| Comparison 2 | " | " | " | " | " | " | " | " | " | " |
| Embodiment 6 | a-SiN:H/F | 28 | 500 | 16/5 | " | a-SiN:H/F | 28 | 10 | 16/5 | " |
| Embodiment 7 | " | " | " | " | " | " | " | " | " | " |
| Embodi- | a-SiC:H/F | 11 | 2500 | 18/6 | | a-SiC:H/F | 11 | 2 | 18/6 | |

TABLE 4-continued

| | | | | | | | | | | | |
|---|---|---|---|---|---|---|---|---|---|---|---|
| ment 8 Embodiment 9 | " | " | " | " | " | " | " | " | " | " | |

| No. | Charge generating layer Composition | H (%)/F (%) | Film thickness (μm) | Surface modifying layer Composition | O (%) | C (%) | H (%)/F (%) | Film thickness (μm) | Working humidity of photosensitive member 50% Image quality after 200,000 copies white blanking and blur | Working humidity of photosensitive member 80% Image quality after 200,000 copies white blanking and blur | Charging potential $V_0$ (V) |
|---|---|---|---|---|---|---|---|---|---|---|---|
| Embodiment 1 | a-Si:H | 18/0 | 4.5 | a-SiN:O:H | 1 | 40 | 20/0 | 0.15 | ○ | ○ | ⊕ 660 |
| Embodiment 2 | " | " | " | " | 5 | " | " | " | ◎ | ◎ | ⊕ 640 |
| Embodiment 3 | " | " | " | " | 10 | " | " | " | ◎ | ◎ | ⊕ 660 |
| Embodiment 4 | " | " | " | " | 30 | 25 | " | " | ◎ | ◎ | ⊕ 670 |
| Embodiment 5 | " | " | " | " | 50 | | " | " | ◎ | ◎ | ⊕ 680 |
| Comparison 1 | " | " | " | " | 0.8 | " | " | " | Δ | Δ | ⊕ 530 |
| Comparison 2 | " | " | " | " | 60 | 20 | " | " | Δ | X | ⊕ 670 |
| Embodiment 6 | a-Si:H/F | 16/5 | " | a-SiN:O:H/F | 5 | 30 | 18/6 | " | ◎ | ◎ | ⊕ 630 |
| Embodiment 7 | " | " | " | " | 10 | 50 | " | " | ◎ | ◎ | ⊕ 650 |
| Embodiment 8 | " | " | " | " | 5 | 30 | " | " | ◎ | ◎ | ⊕ 650 |
| Embodiment 9 | " | " | " | " | 10 | 50 | " | " | ◎ | ◎ | ⊕ 670 |

According to the results obtained, the image regenerative characteristics and the like of the photoreceptor are seen to have been largely improved if the quantity of oxygen contained in the surface modifying layer is set at 1~50%, especially 2~10%. With respect to image quality, ◎ represents clear image; ○ good image; Δ image quality practically acceptable; and X image quality practically unacceptable.

We claim:

1. A photosensitive member comprising a charge transporting layer prepared from at least one selected from a group of a-SiC:H, a-SiC:F, a-SiC:H:F, a-SiN:H, a-SiN:F, and a-SiN:H:F; a charge generating layer prepared from at least one selected from a group of a-Si:H, a-Si:F and a-Si:H:F; and a surface modifying layer prepared from at least one selected from a group of a-SiC:H, a-SiC:F, a-SiC:H:F, a-SiN:H, a-SiN:F and a-SiN:H:F, said charge transporting, charge generating and surface modifying layers being laminated on a retainer, said surface modifying layer containing 1~50 atomic % of oxygen, 100 atomic % in total of Si, C (or N) and O atoms.

2. A photosensitive member as claimed in claim 1, wherein a charge blocking layer prepared from at least one selected from a group of a-SiC:H, a-SiC:F, a-SiC:H:F, a-SiN:H, a-SiN:F, and a-SiN:H:F is provided between said charge transporting layer and the carrier.

3. A photosensitive member as claimed in claim 1, wherein the quantity of C or N contained in said surface modifying layer is 10~70 atomic %, the total number of Si, C (or N) and O atoms in said surface modifying layer being 100 atomic %.

4. A photosensitive member as claimed in claim 2, wherein the quantity of C or N contained in said surface modifying layer is 10~70 atomic %.

5. A photosensitive member as claimed in claim 1, wherein said surface modifying layer contains 5~30 atomic %.

6. A photosensitive member as claimed in claim 2, wherein said charge blocking layer contains 50~500 atomic ppm.

7. A photosensitive member as claimed in claim 2, wherein said charge blocking layer contains 50 atomic ppm~5 atomic % of O, the total number of Si, C (or N) and O atoms in said blocking layer being 100 atomic %.

8. A photosensitive member as claimed in claim 2 wherein said charge blocking layer is doped with an element from Group IIIa of the Periodic Table of Elements.

* * * * *